United States Patent [19]

Chen

[11] Patent Number: 4,869,853

[45] Date of Patent: Sep. 26, 1989

[54] WARM MIST HUMIDIFIER WITH AUTOMATIC CLEANING DEVICE

[76] Inventor: C. H. Chen, P.O. Box 1-79, Taipei, Taiwan, 10602

[21] Appl. No.: 293,629

[22] Filed: Jan. 5, 1989

[51] Int. Cl.[4] ..... F22B 1/28

[52] U.S. Cl. ..... 261/142; 219/273; 219/275

[58] Field of Search ..... 261/142; 219/273, 275

[56] References Cited

U.S. PATENT DOCUMENTS

| | | | |
|---|---|---|---|
| 4,125,953 | 11/1978 | Colombo | 219/273 |
| 4,190,052 | 2/1980 | McCarthy | 219/273 |
| 4,480,172 | 10/1984 | Ciciliot et al. | 219/275 |
| 4,657,713 | 4/1987 | Miller | 219/273 |
| 4,776,990 | 10/1988 | Verity | 261/142 |
| 4,810,854 | 3/1989 | Jursich | 219/273 |

*Primary Examiner*—Tim Miles

*Attorney, Agent, or Firm*—Lalos & Keegan

[57] ABSTRACT

A warm mist humidifier wherein the steam-heating means thereof is composed of an outer heating means and an inner heating means having a plurality of oblique blades mounted around its upper periphery. A thin layer of water flowing from a reservoir between said outer heating means and inner heating means is rapidly heated into steam when disposed beneath the steam-heating means a heater is actuated, the ascending steam thrust on the blades to rotate the inner heating means to rub the outer heating means continuously, preventing minerals or other deposits from depositing thereon and permitting the deposits to be carried by hot water to a collector disposed around the outer heating means and there after to a filter means through a groove for filtering, thereby eliminating the disadvantage of usually manual cleaning of the humidifier.

13 Claims, 6 Drawing Sheets

WARM MIST HUMIDIFIER WITH AUTOMATIC CLEANING DEVICE

BACKGROUND OF THE INVENTION

The present invention relates to a warm mist humidifier, and more particularly to a warm mist humidifier with an automatically cleaning device which is capable of automatically cleaning up deposits on the steam heater of the humidifier.

In the frigid zone, the air is always very dry with low humidity in winter, consequently, the human respiratory system will become abnormal under influences of such dry air. As a result, the humidifier is widely applied to increase the air humidity. The used humidifiers are classified according to the forms of mist into the following two types: cool mist and warm mist types. Due to the higher amount of bacteria contained in the cool mist, the warm mist humidifier is more commonly accepted by people.

Referring to FIGS. 7 and 8, a prior warm mist humidifier is shown having a humidifier body 100, a mist room 101 equipped with a nozzle 102, a water tank 103, a humidity controller 104, a power switch as well as warm mist controller 105, a steam heater 106, a reservoir 107, and a mist blast fan 108. During heating operation, the minerals and suspensions contained in the water will soon deposit on the steam heater 106 because of the water-softening procedure, and thus reduce the heating efficiency. Inevitably, the steam heater 106 must be cleaned off, usually with a brush 109 or the like to remove the sediment (as shown in FIG. 8).

SUMMARY OF THE INVENTION

A primary object of this invention is to provide a warm mist humidifier which is equipped with a cleaning device capable of automatically cleaning the steam heater from sediment.

A further object of this invention is to provide a warm mist humidifier wherein the steam heater is composed of an inner heating bowl and an outer heating bowl with said inner one being buoyant on water contained in the outer one, whereby the blades disposed on the periphery of the inner heating bowl can be thrusted by the ascending steam, urging the inner heating bowl to revolve against the surface of outer heating bowl, thus preventing the sediment from depositing thereon.

A still further object of this invention is to provide a humidifier wherein the water from the reservoir is spirally directed to the outer heating bowl, whereby the water can be heated in a gradual manner and a rapidly transformed into hot steam once it enters the outer heating bowl with least time and most economic consumption of energy.

A still further object of this invention is to provide a humidifier wherein there only exists a thin layer of water between the inner heating bowl and outer heating bowl with the inner heating bowl floating on the outer one, thereby enabling the water to be rapidly heated into steam.

A even more further object of this invention is to provide a humidifier wherein the hot water containing produced sediment can be diversed through a channel into a filter tank, whereby the sediment can be filtered out from clean water, permitting the same to flow back to original reservoir and circulate again therefrom.

A still further object of this invention is to provide a humidifier wherein said filter tank has a sediment absorber which can be easily removed therefrom without opening the mist room, thus facilitating the cleaning procedure.

DETAILED DESCRIPTION OF THE PREFERRED EMBODIMENTS

Figure 1:
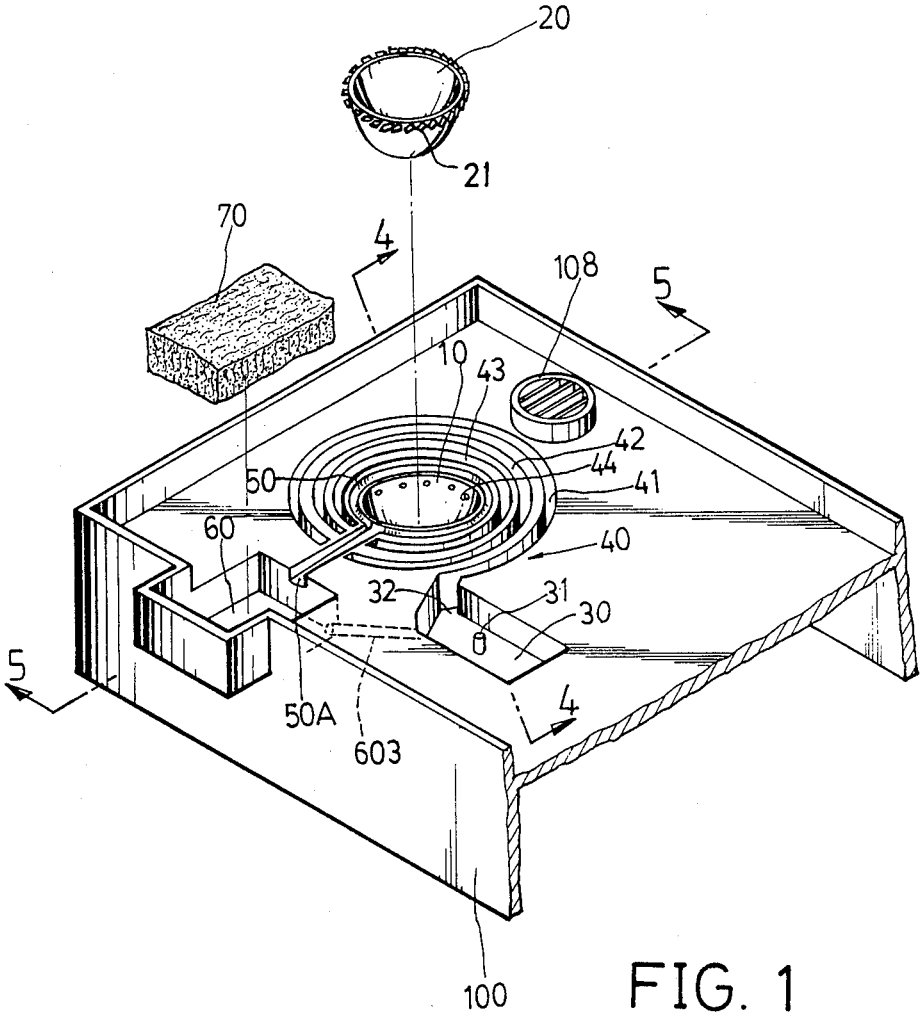
FIG. 1 is a partly exploded, perspective view of a preferred embodiment of a warm mist humidifier in accordance with the invention.

Now the detailed construction of the preferred embodiment in accordance with the present invention will be described with reference to the accompanying drawings in which like numerals designate the same parts throughout the drawings.

It should be realized that this invention uses a water tank 103, a mist room 101, a nozzle 102, and a humidifier body 100 containing a humidity controller 104, a warm mist controller 105, a blast fan 108 the same as in the prior art, therefore a detailed description thereof is omitted.

It is to be emphasized first that the main difference between this invention and the prior warm mist humidifier lies in that in accordance with the invention, the steam produced by the outer heating bowl can impinge the peripheral blades of the inner heating bowl to urge the same rotate and rub the surface of the outer heating bowl continuously so as to prevent minerals or other sediments from depositing thereon. Alternatively, the ascending steam can bring the sediments to a channel, then to a filter for filtering.

Figure 2:
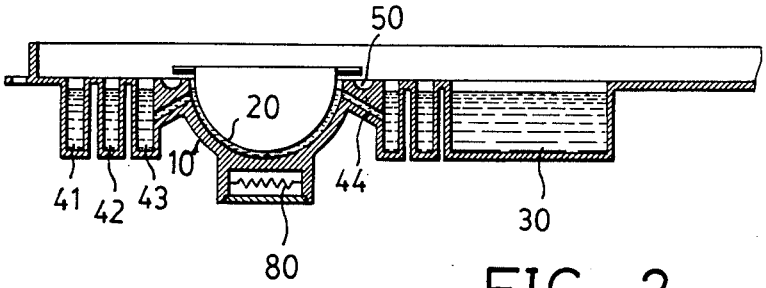
FIG. 2 is a cross-sectional view taken on line 4—4 in FIG. 1.
Figure 3:
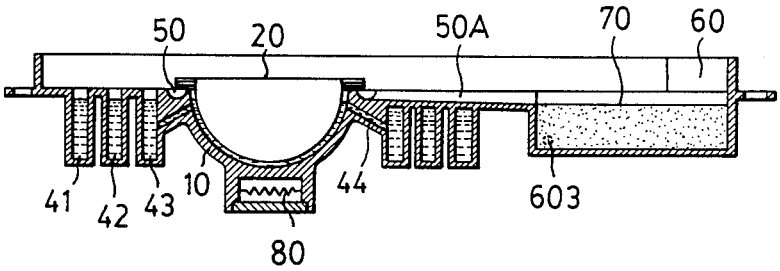
FIG. 3 is a cross-sectional view taken on line 5—5 in FIG. 1.

With reference to FIGS. 1 and 2, it is shown that a reservoir 30 having a water level control pin 31 is disposed on a humidifier body 100 with its water level control pin 31 urging against an outlet of a water tank 103 (not shown). An outlet 32 of the reservoir 30 leads the water through a spiral water passage 40 to a outer heating bowl 10. Referring now to FIGS. 1, 2 and 3, it can be seen that the spiral water passage 40 goes from an outer loop 41 through a mediate loop 42 and then to an inner loop 43 communicated with the outer heating bowl 10 through a plurality of inclined tunnels 44. An annual collecting groove 50 is disposed around the outer heating bowl 10 for collecting minerals and other sediments. Said collecting groove 50 further leads to a filter tank 60 having an sediment absorber 70 through a channel 50A.

Referring now back to FIG. 3, it is seen that the filter tank 60 is located some distance from the humidifier body 100, whereby the absorber 70 can be removed and cleaned easily without opening the mist room. A flowing-back tunnel 603 is disposed between the reservoir 30 and filter tank 60 to keep the water level of outer heating bowl 10, filter tank 60 and reservoir 30 identical to each other under the control of water level control pin 31. Thus, clean water can flow back into the reservoir 30 and circulate again therefrom after the sediment is filtered out. So the water can be reused without waste.

Figure 4A:
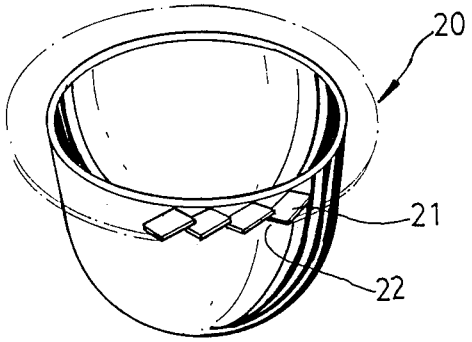
FIG. 4A is a perspective view of an embodiment of the inner heating bowl in accordance with the invention.
Figure 4B:
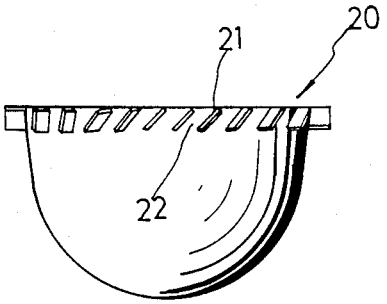
FIG. 4B is a front view of FIG. 4A.

Now with reference to FIGS. 4A and 4B which show an inner heating bowl 20 having several peripherally inclinedly disposed blades 21. The outer surface of the inner heating bowl 20 is so designed that it fits in closely with the inner surface of the outer heating bowl 10, causing a thin layer of water between said two surfaces. The abovementioned blades are preferably formed in an oblique angle of 45° and kept spaced from each other, permitting to exist between two blades. When the inner heating bowl 20 having appropriate weight is put inside the outer heating bowl 10, as shown in FIG. 3, with the water level of the outer heating bowl 10 being 5 mm lower than the top thereof, a thin layer of water between the inner heating bowl 20 and outer heating bowl 10 is acquired with the inner heating bowl 20 suitably floating within the outer heating bowl 10. Moreover, the water flowing from the spiral water passage 40 into the outer heating bowl 10 is preheated during its travel through the winding passage 40, thus, once a heater 80 beneath the outer heating bowl 10 is activated, said thin layer of water existing between the inner heating bowl 20 and outer heating bowl 10 is rapidly transformed into hot steam and rushes upward. Consequently, when the steam thrusts on the blades 21 around the inner heating bowl 20 and passes through the spaces 22 between the blades 21, the inner heating bowl 20 is urged to rotate inside the outer heating bowl 10 and rub the inner surface of the outer heating bowl 10 continuously, thus the minerals or other deposits produced by the heating process will not remain on the outer heating bowl 10, but be brought upward by the ascending steam. When the boiling water overflows the outer heating bowl 10, the sediments finally are collected in the annual collecting groove 50 disposed along the upper periphery of the outer heating bowl 10 due to their heavier weight and then directed into the filter tank 60 through the groove 50A for filtering. Thus, the object of automatically cleaning the heating bowl is achieved.

Figure 5:
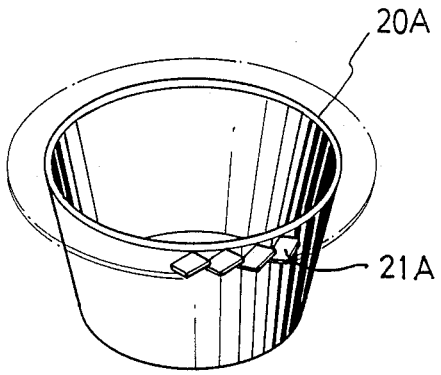
FIG. 5 is a perspective view of another embodiment of the inner heating bowl in accordance with the invention.
Figure 7:
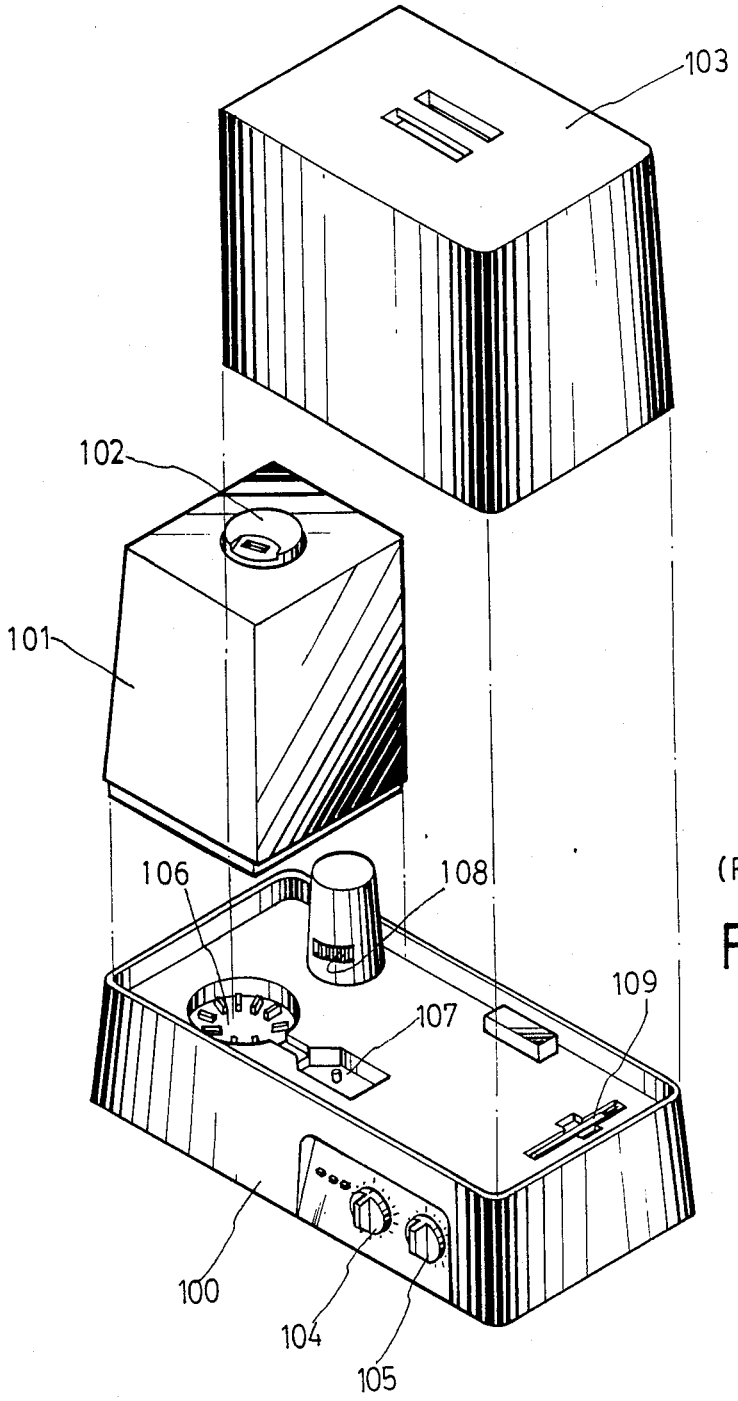
(PRIOR ART) FIG. 7
FIG. 7 is a partly exploded view of a conventional warm mist humidifier.
Figure 8:
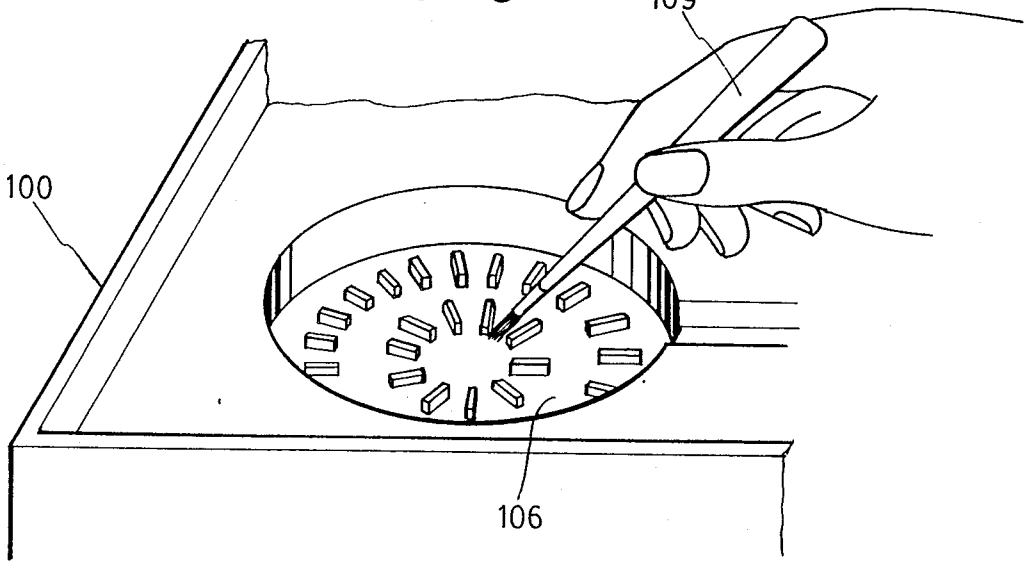
(PRIOR ART) FIG. 8
FIG. 8 shows the cleaning of the steam heater of the conventional warm mist humidifier.

It should be mentioned that in the embodment heretofore described the inner heating bowl 20 and the outer heating bowl 10 are shaped to be semi-spherical, however, other shapes such as illustrated in FIG. 5 or other configurations like cylinders are also possible to achieve the same effects and objects of this invention as mentioned above.

Besides, in order to make the relative revolution of the inner heating bowl 20 to outer heating bowl 10 more smooth and the deposits more difficult to deposit therebetween, the outer heating bowl 10 and the inner heating bowl 20 can be further processed with teflon covered thereon.

Figure 6:
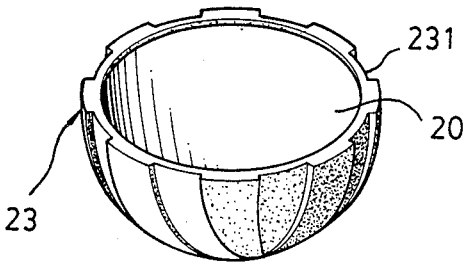
FIG. 6 shows still another embodiment of the inner heating bowl, having an outer cover made of heat-resistant and wear-resistant rubber on which several oblique grooves are disposed for rotating the inner heating bowl.

Further referring to FIG. 6, an alternative embodiment of the inner heating bowl 20 having an outer cover 23 is illustrated. The inner heating bowl 20 is externally overlaid with a cover 23 which is preferably made of heat-resistant and weat-resistant rubber. Furthermore, a plurality of oblique grooves 232 are disposed on the outer surface of the cover 23 instead of precedingly described blade 21. When the water between the cover 23 and outer heating bowl 10 becomes steam and blows out through the oblique grooves 231, a rotating force is applied on the inner heating bowl 20 since the oblique walls of grooves 232 will receive a horizontal decomposed force when thrusted by rapidly ascending steam.

The wear-resistant rubber cover 23 can provide the inner heating bowl 20 for enhanced rubbing force against the inside surface of the outer heating bowl 10, thus more effectively bringing the deposits away therefrom for filtering.

As many other variations may be made by those skilled in the art without departing from the spirit and scope of this invention, it is desired that the scope of this invention be limited only by the appended claims rather than by the purely illustrative embodment shown and described herein.

I claim:

1. A warm mist humidifier with automatic cleaning device, comprising:

a humidifier body;

a mist room disposed on said humidifier body, having a nozzle arranged on the upper side;

a water tank disposed adjacent to said mist room on said humidifier body;

a humidity controller set inside said humidifier body;

a warm mist amount controller set also inside said humidifier body;

a steam-heating means disposed inside said mist room;

a reservoir for supplying water into said steam-heating means;

a heater disposed beneath said steam-heating means and controlled by said warm mist amount controller; and a blast fan disposed next to said steam-heating means for aiding the hot steam to disperse outward from said mist room;

said warm mist humidifier being characterized in that said steam-heating means is composed of an outer heating means and an inner heating means, wherein said outer heating means is heated by said heater, and said inner heating means has a preset weight and floats on the water contained in said outer heating means with its weight balancing the buoyancy applied to it, so that only a thin layer of water exists between the surfaces of said outer and inner heating means;

means for being rotated provided at the periphery portion of said inner heating means being activated when the thin layer of water between said outer and inner heating means is heated into steam and rushes upward, said inner heating means being thus rotated automatically relatively to said outer heating means rubbing the surface thereof to prevent deposits from accumulating on said surface.

2. The warm mist humidifier with automatic cleaning device of claim 1, wherein said outer and inner heating means are bowl-shaped.

3. The warm mist humidifier with automatic cleaning device of claim 1, wherein said outer and inner heating means is cylindrically shaped.

4. The warm mist humidifier with automatic cleaning device of claim 1, wherein the water in said reservoir is spirally guided into said outer heating means through a windingly disposed channel.

5. The warm mist humidifier with automatic cleaning device of claim 1, wherein a deposit-collecting means is disposed around the upper periphery of said outer heating means for collecting minerals and other deposits in the boiling water overflowing said outer heating means.

6. The warm mist humidifier of claim 5, wherein said collecting means is communicated with a filter means through a groove.

7. The warm mist humidifier of claim 6, wherein a deposit-absorbing means is disposed in said filter means for filtering minerals or other deposits in the hot water.

8. The warm mist humidifier of claim 6, wherein said filter means is disposed some distance from said humidifier body, whereby said deposit-absorbing means can be easily removed for cleaning and installed for reusing.

9. The warm mist humidifier of claim 1, wherein a tunnel is disposed between said filter means and said reservoir, permitting the water free of deposits to flow back to said reservoir and serving the humidifier again without waste.

10. The warm mist humidifier of claim 1, wherein the water level of said heating means, filter means and reservoir are controlled to be identical to each other.

11. The warm mist humidifier of claim 1, wherein oblique blade means are mounted around the upper periphery of said inner heating means for receiving the thrusting force of steam to rotate said inner heating means.

12. The warm mist humidifier of claim 2, wherein said bowl-shaped inner heating means is externally overlaid with a cover having a plurality of oblique grooves for receiving the thrusting force of steam to rotate said inner heating means.

13. The warm mist humidifier of claim 12, wherein said cover is made of heat-resistant and wear-resistant rubber.

* * * * *